United States Patent [19]

Gorges et al.

[11] 4,178,173

[45] Dec. 11, 1979

[54] PROCESS FOR PRODUCING STAINLESS STEELS

[75] Inventors: Helmut Gorges; Heinrich Brod; Wilfried Pulvermacher, all of Bochum; Wolfgang Rübens, Witten-Stockum; Otto Fischer, Bochum, all of Fed. Rep. of Germany

[73] Assignee: Fried. Krupp Hüttenwerke Aktiengesellschaft, Bochum, Fed. Rep. of Germany

[21] Appl. No.: 932,598

[22] Filed: Aug. 10, 1978

[30] Foreign Application Priority Data

Aug. 22, 1977 [DE] Fed. Rep. of Germany ..... 2737832

[51] Int. Cl.[2] ..... C21C 5/32; C21C 5/34

[52] U.S. Cl. ..... 75/60; 75/52; 75/59

[58] Field of Search ..... 75/60, 59, 52

[56] References Cited

U.S. PATENT DOCUMENTS

| | | | |
|---|---|---|---|
| 3,046,107 | 7/1962 | Nelson | 75/60 |
| 3,706,549 | 12/1972 | Knuppel | 75/60 |
| 3,854,932 | 12/1974 | Bishop | 75/60 |
| 3,953,199 | 4/1976 | Michaelis | 75/60 |
| 4,001,009 | 1/1977 | Bauer | 75/60 |

*Primary Examiner*—P. D. Rosenberg

*Attorney, Agent, or Firm*—Sprung, Felfe, Horn, Lynch & Kramer

[57] ABSTRACT

Disclosed herein is an improvement in a process for preparing a stainless steel of low carbon content from a steel melt containing chromium or chromium nickel of higher carbon content where the process is carried out in a converter having at least one blast nozzle below the molten steel bath level and at least one blast lance above the bath level wherein oxygen is supplied to the steel melt through the blast lance and inert gas is supplied through the blast nozzle during a first refining phase, and in a succeeding refining phase oxygen is combined with inert gas and introduced through the blast nozzles to the steel melt, the proportion of the oxygen being reduced in relationship to the proportion of inert gas with decreasing carbon content of the steel melt. The improvement of the invention permits a decrease in the amount of inert gas supplied during the first refining phase while not significantly increasing the refining time. The improvement resides in employing as at least one of the nozzles one having an axially movable bar within the passageway of the nozzle, the bar being extended through the nozzle passageway to the mouth of the nozzle during the first refining phase and being withdrawn from the mouth of the nozzle during the successive refining phase. By such an expedient, the amount of gas passing through the nozzle in the first refining phase is reduced, and the amount of gas passing through the nozzle in the successive refining phase is increased.

2 Claims, 2 Drawing Figures

PROCESS FOR PRODUCING STAINLESS STEELS

BACKGROUND OF THE INVENTION

1. Field of the Invention

This invention relates to stainless steels of high chromium content and particularly to stainless steels having as low a carbon content as possible. This invention is concerned with stainless steels having excellent corrosion resistance and resistance to intercrystalline corrosion. More especially, this invention relates to an improved process for producing such steels wherein the amount of inert gas normally required during a first refining phase can be reduced without significant increase in the amount of time required for the refining operation.

2. Discussion of the Prior Art

A process for producing such stainless steels is known from the German Offenlegungsschrift No. 25 25 355, wherein a steel melt containing chromium or chromium and nickel with higher carbon contents, e.g., 1%, is refined in a converter which has at least one blast nozzle below the bath level and at least one blast lance above the bath level, whereby in several refining phases oxygen is supplied to the steel melt through the blast lance and inert gas through the blast nozzle in the first refining phase and in the succeeding refining phases oxygen combined with inert gas is supplied to the steel melt through the blast nozzles. It is here recommended to reduce the proportion of oxygen supplied in relation to the proportion of inert gas with a decreasing carbon content in the steel melt. A corresponding step is described, for example, in the publication "Stahl und Eisen" 1976, on pages 1255/1256.

In carrying out such a process the blast lances are no longer used in the succeeding refining phases following the first refining phase, the refining means being introduced exclusively by being blown through the nozzles. Generally speaking, the refining means (oxygen) is combined with an inert gas, in particular argon. In order to carry out the refining process in an economically feasible manner and within a reasonable time, it is desirable to supply as much gas as possible to the steel melt in the succeeding refining phases. As this can only occur through the nozzles, it has heretofore been necessary to employ blast nozzles with a correspondingly large cross-section. This has meant that a high amount of inert gas has been employed in the first refining phase—an amount of inert gas substantially greater than would be required by the demands of the first refining phase. The first refining phase requires only that amount of inert gas introduced through the nozzles to circulate the molten steel and to cool the nozzle itself. At the same time, the blowing in of inert gas prevents the molten steel from penetrating into the blast nozzles. As stated heretofore, a large amount of inert gas was necessary to protect the blast nozzles.

It is an object of this invention, therefore, to provide a process which enables a decrease in the proportion of inert gas introduced into the first refining phase while maintaining a short refining period.

SUMMARY OF THE INVENTION

The object stated above is provided in accordance with the present invention which provides an improvement in a process for producing a stainless steel of very low carbon content from a steel melt containing chromium or chromium nickel having a higher carbon content in a converter which has at least one blast nozzle below the molten steel bath level and at least one blast lance above the bath level wherein:

A. In a first refining phase oxygen is supplied to the steel melt through said blast lance and inert gas is supplied through said blast nozzle; and B. In a succeeding refining phase oxygen in admixture with inert gas is supplied to said bath through said blast nozzle and the proportion of oxygen supplied is reduced in relationship to the proportion of inert gas with a decreasing carbon content in the steel melt.

The present invention resides in an improvement permitting a decrease in the amount of inert gas supplied during the first refining phase while not significantly increasing the refining time, said improvement comprising employing as at least one of said nozzles one having an axially movable bar within the passageway of said nozzle, said bar being:

1. Extended through said nozzle passageway to the mouth of said nozzle during said first refining phase; and 2. Said bar being withdrawn from said mouth during the successive refining phase, whereby the amount of gas passing through said nozzle during said first refining phase is reduced, and the amount of gas passing through said nozzle during the successive refining phase is increased.

As indicated above, the objects are solved by the utilization of a blast nozzle whose cross-section can be changed by the use of an axially shiftable bar which extends through the nozzle, the bar being advanced with its free end up to the nozzle mouth in the first refining phase, whereby the nozzle cross-section is reduced as much as possible and the bar being withdrawn from the nozzle mouth in the succeeding refining phases until the nozzle cross-section has been increased as much as possible.

According to a preferred embodiment of the invention, the steel is refined to a carbon content of below 0.45% in the first refining phase, whereby the nozzle cross-section is decreased directly at the nozzle mouth in the first refining phase by at least 30% in relation to succeeding refining phases. It is particularly advantageous to reduce the cross-section of the blast nozzles by more than 50%.

It is important in following the invention that the bar employed be axially movable and extend over the entire length of the nozzle and that the same be advanced in the first refining phase with its free front end up to the nozzle mouth. As a result, there is no danger during the first refining phase that molten steel will penetrate into the nozzle even with the greatly reduced amounts of inert gas utilized in the first refining phase, as the pressure of the inert gas remains unaltered with a considerably reduced amount. For the succeeding refining phases, the bar is withdrawn from the nozzle through a stuffing box attached to the end of the nozzle so that the nozzle is available for the refining process with its full cross-section.

Suitably, the nozzle is one which is approximately 1 meter in length in the case of a newly lined converter. It wears from the front end of the nozzle with the refractory lining to approximately half its length during the course of the converting process. In the first refining phase, the advanced bar wears together with the nozzle as it reaches the nozzle mouth with its free front end. This abrasion or wearing, however, is insignificant insofar as the functioning of the nozzlebar assembly is concerned, since the nozzle and bar have a constant cross section over their length and they therefore wear together. The bar arranged in the nozzle can, for example, be composed of a ceramic material or of metal, in particular copper.

It has been observed that the reduction in cross-section provided by the advancement of the bar in the nozzle during the first refining phase and the concomitant reduction of supply of inert gas do not impair the melting time as sufficient inert gas is still supplied to the steel melt to keep the bath moving. At the same time, however, the pressure and the flow velocity of the reduced amount of inert gas is sufficient to protect the blast nozzles effectively against penetration by the molten steel. Therefore, one can considerably reduce the amount of inert gas required during the first refining phase well below the amounts required by prior art procedures without impairing the metallurgical result or the refining time required. Thus, it has been found that with 80 tons of molten steel the amount of inert gas could be reduced in the first refining phase from a prior art amount requirement of 0.40 $Nm^3/t$ min. to less than 0.20 $Nm^3/t$ min.

In the case of melts of 60 to 80 tons, it is desirable to carry out the first refining phase for 8 to 15 minutes, in particular about 12 minutes, whereby the carbon content of 1.5 to 2.0% by weight, for example, can be reduced to less than 0.4% by weight.

In the first refining phase it is advantageous to inject 10 to 15 $Nm^3$ of inert gas per minute through the available nozzles, whereby in each nozzle the bar is advanced with its free end up to the nozzle mouth. In contrast to this, in prior art procedures about 25 $Nm^3$ of inert gas per minute were required. Two further refining phases follow in which the refining takes place without using the top blowing oxygen lance, but employing only the nozzles which terminate below the bath level. These nozzles are equipped with the bar, the bar having been drawn out of the nozzle. In the case of the process of the invention, at least 50 $Nm^3$ of gas per minute is supplied to the molten bath during the succeeding refining phase, whereby the mixture ratio of argon gas to oxygen amounts initially to about 1:1 and with decreasing carbon content, changes to about 1:2, i.e., the amount of expensive inert gas can be significantly reduced during this succeeding refining phase. Carbon contents of 0.12 to 0.18% by weight are achieved without substantial chromium slagging with a mixture ratio of 1:1. Carbon contents of 0.03% by weight are achieved with the mixture ratio of 1:2. The mixture ratios of argon to oxygen are expressed in a volume percent.

BRIEF DESCRIPTION OF DRAWINGS

The invention can be more readily understood and appreciated when reference is made to the accompanying drawings, in which.

DESCRIPTION OF SPECIFIC EMBODIMENT

Figure 1:
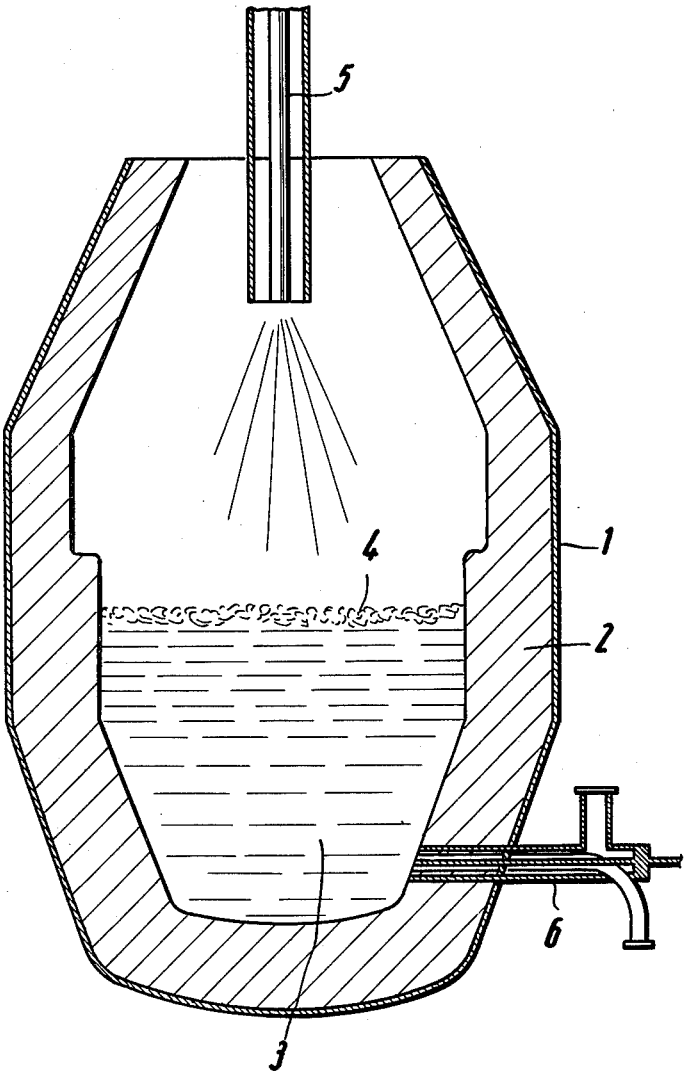
FIG. 1 shows a cross-section of a coneverter equipped with a nozzle according to the invention.

Referring to the drawings, converter 1 is provided with a refractory lining. Molten steel 3 has a bath level 4 and is contained within the converter. Slag (not shown) is usually found on the bath level. A blast lance 5 is disposed above the bath level and reaches into the mouth of the converter. Several blast nozzles 6 are arranged below the bath level 4. The blast nozzles are distributed on the half of the converter slightly above the floor of the converter. Three to six blast nozzles, for example, can be arranged at equal distances from one another.

Figure 2:
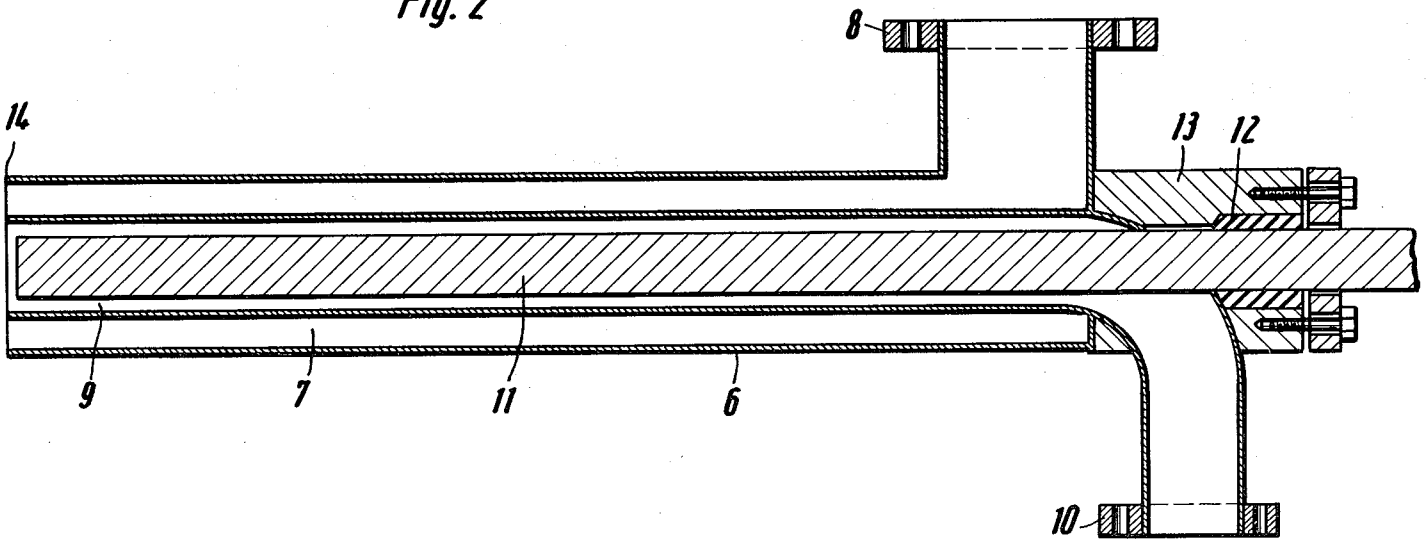
FIG. 2 shows an enlargement of a blast nozzle employed in accordance with the invention, said blast nozzle being depicted in cross-section.

Referring to FIG. 2, each of the blast nozzles 6 is composed of a jacket tube 7 with a terminal 8 and a central tube 9 arranged axially. The central tube 9 is also in gaseous fluid communication with terminal 10. A bar 11, which extends with constant cross-section directly from the nozzle mouth 14 to the nozzle end 13 over the entire length of the blast nozzle 6, is positioned in the central tube 9 coaxially to the jacket tube 7 and the central tube 9. The bar 11 can be inserted at the nozzle end 13 by means of a stuffing box 12. The bar can, for example, be advanced by mechanical means (not shown) so far that the front free end reaches directly to the nozzle mouth 14. It can be withdrawn from the nozzle mouth by the stuffing box 12. In FIG. 2, bar 11 has about half the cross-section of the diameter of the central tube 9. Such a cross-section has proven favorable in practice.

We claim:

1. In a process for producing stainless steel of very low carbon content from a steel melt containing chromium or chromium nickel having a higher carbon content in a converter which has at least one blast nozzle below the molten steel bath level and at least one blast lance above the bath level wherein:

A. In a first refining phase oxygen is supplied to the steel melt through said blast lance and inert gas is supplied through said blast nozzle; and B. In a succeeding refining phase oxygen in admixture with inert gas is supplied to said bath through said blast nozzle and the proportion of oxygen supplied is reduced in relationship to the proportion of inert gas with the decreasing carbon content in the molten steel, the improvement permitting a decrease in the amount of inert gas supplied during said first refining phase without significantly increasing the refining time, which improvement comprises employing as at least one of said nozzles one having an axially movable bar within the passageway of said nozzle, said bar being:

1. Extended through said nozzle passageway to the mouth of said nozzle during said first refining phase; and
2. Said bar being withdrawn from said mouth during the successive refining phase, whereby the amount of gas passing through said nozzle during said first refining phase is reduced and the amount of gas passing through said nozzle during the successive refining phase is increased.

2. A process according to claim 1 wherein the steel is refined to a carbon content of below 0.45% by weight during the first refining phase employing a nozzle whose cross-section is reduced by the presence of said bar therein by at least 30% in relation to its cross-section during a succeeding refining phase.

* * * * *